United States Patent [19]

Winkler

[11] 4,299,368

[45] Nov. 10, 1981

[54] INFINITELY ADJUSTABLE BRACKET-STANDARD MOUNTING

[76] Inventor: Clifford W. Winkler, P.O. Box 561, Rte. 2, Houghton Lake, Mich. 48629

[21] Appl. No.: 21,657

[22] Filed: Mar. 19, 1979

[51] Int. Cl.[3] ..... A47G 29/02

[52] U.S. Cl. ..... 248/246; 108/108

[58] Field of Search ..... 108/108; 248/244, 246, 248/243, 245

[56] References Cited

U.S. PATENT DOCUMENTS

| | | | |
|---|---|---|---|
| 2,677,519 | 5/1954 | Hobson | 248/246 |
| 3,375,936 | 4/1968 | Kessler | 248/246 X |
| 4,033,540 | 7/1977 | Hamblin | 248/246 |
| 4,156,515 | 5/1979 | Mochly | 108/108 X |

FOREIGN PATENT DOCUMENTS

| | | | |
|---|---|---|---|
| 1085781 | 10/1967 | United Kingdom | 248/245 |

*Primary Examiner*—Francis K. Zugel

*Attorney, Agent, or Firm*—Krass, Young & Schivley

[57] ABSTRACT

An adjustable bracket-standard mounting arrangement for supporting shelving systems is disclosed in which the bracket is secured to the standard by a frictional interengagement therebetween established by movement of the bracket from a tilted position to the adjusted horizontal position at the selected height. The standard consists of a boxed channel having a longitudinal slot on its front side, which retains the bracket by receiving a pair of laterally extending ears on the top of one end of the bracket. The bracket is formed in a T-section, including a gusset plate having a tail portion extending to the rear of the bracket ears, moved into engagement with a track or slot extending along the rear wall of the box channel upon locking of the bracket in position. Locking frictional forces are established between the tail portion and the rear and side of the track. The bracket is inserted into the box channel either by passing the ears through the open end of the standard or by passing the same into one or more slotted openings extending into the front side of the box channel, configured to pass the bracket ears.

12 Claims, 15 Drawing Figures

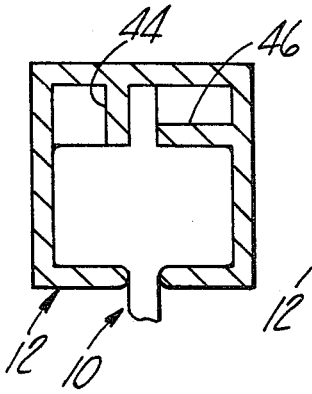
Fig-9
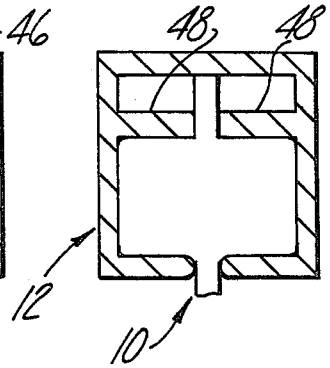
Fig-10
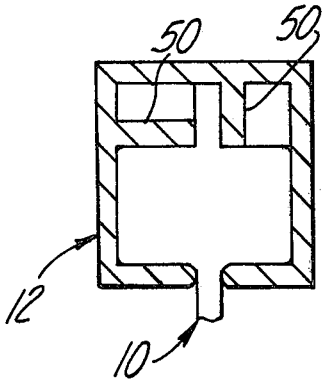
Fig-11
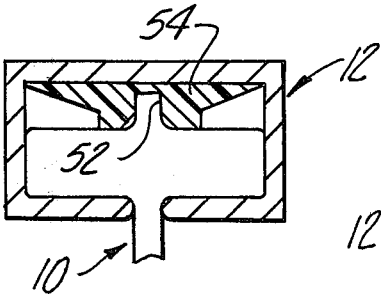
Fig-12
Fig-13
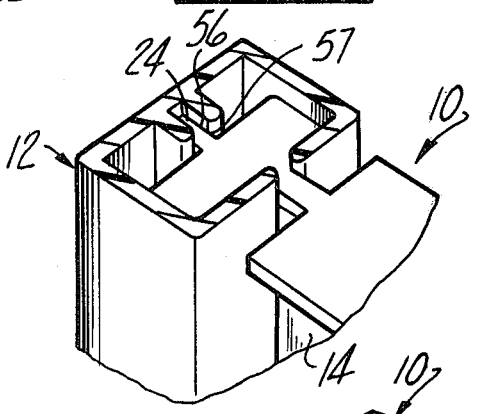
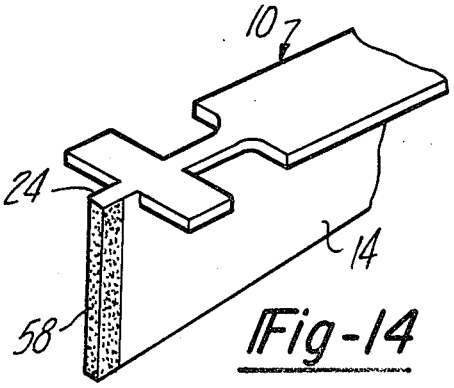
Fig-14
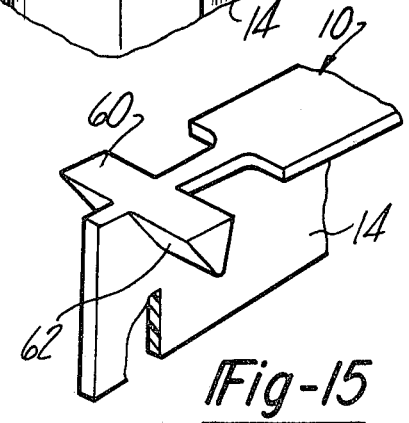
Fig-15

INFINITELY ADJUSTABLE BRACKET-STANDARD MOUNTING

BACKGROUND DISCUSSION

It is often desirable to provide for adjustability in the height of mounting horizontal brackets secured to vertically extending standards mounted to a wall surface or other mounting location, as in the case of shelving systems. In order to adapt the shelving systems to particular requirements, the common approach to providing such a capability is an incremental system which prongs on the bracket are inserted into a selected set of slot series formed along the standard.

Such approach limits the selection of the particular adjusted position of the bracket to the incremental positions corresponding to the slot series, and it would of course be advantageous if an infinite adjustment of the bracket position were possible.

Furthermore, such bracket-standard mounting arrangements are often incorporated in shelving systems in which aesthetic appeal is important and the provision of visible openings reduces the aesthetic appeal of the bracket-standard system.

This being the case, there has heretofore been provided a bracket-standard mounting arrangement in which a frictional interengagement between the bracket and the standard is established at an adjusted position and which frictional interengagement may be controllably established such as to provide a convenient adjustment of the height with respect to the standard and the frictional interengagement established at the selected height to secure the bracket in place.

One such system is disclosed in U.S. Pat. Nos. 4,033,540 and 4,098,482. The bracket-standard mounting arrangement disclosed therein provides for such infinite adjustment, but this approach involves the use of separate parts in addition to the bracket and standard, which increases the cost of packaging and manufacturing of the system which may be a critical factor in the marketing of shelving systems incorporating this mounting arrangement.

Some of such bracket-standard mounting arrangements include protuberances or ears formed on a rear portion of the bracket which is retained within a box channel standard, and which serves to produce a fulcrum point for frictional engagement or other securement of the bracket within the box channel. Protuberances are retained by the sidewall portions of the box channel adjacent the central slot through which the bracket gusset portion extends. In order to assemble the bracket to the standard, the bracket must be passed into the open end of the standard.

This latter requirement entails several disadvantages. Firstly, a clearance space must be provided at the top or bottom of the standard which complicates the installation and may possibly be of less aesthetic appeal.

Also, the removal of a bracket intermediate two other brackets necessitates removal of one of the other brackets in order that the intermediate bracket may be removed. This also applies if a bracket is to be added to the system.

In the event a top or bottom clearance space cannot be provided, the only alternative is to remove the bracket when adding or removing brackets from the system.

Other such infinitely adjustable shelving bracket-standard mounting arrangements have been devised which generally have disadvantages of low aesthetic appeal, the requirements of precision manufacturing of the components, which causes an excessive increase in the manufacturing cost of such systems, or which similarly requires separate parts to establish the frictional interengagement or the use of relatively elaborate bracket or standard configurations which will likewise increase the cost of the unit.

Accordingly, it is an object of the present invention to provide a bracket-standard mounting arrangement in which ready and convenient infinite adjustment of the position of the bracket with respect to the standard is afforded.

It is another object of the present invention to provide such a bracket-standard mounting arrangement which does not involve the use of components other than the bracket and standard, and in which the bracket and standard are configured simply so as to be constructed of relatively non-critical shape and dimensions such that it may be manufactured at relatively low cost.

It is still a further object of the present invention to provide such a bracket-standard mounting arrangement which has a high degree of aesthetic appeal and which is very convenient in use such as to be adapted to shelving system applications for home use.

It is still a further object of the present invention to provide a bracket-standard mounting arrangement in which the bracket is trapped within the box channel standard, but which does not necessitate a clearance space in the ends of the standard for assembling the bracket to the standard and which enables removal or addition of brackets intermediate other installed brackets.

SUMMARY OF THE INVENTION

These and other objects of the present invention, which will become apparent upon a reading of the following specification and claims, are achieved by a bracket-standard mounting arrangement in which a bracket is retained within a box channel standard having a frontal longitudinally extending slot through which the bracket extends. A pair of upper protuberances or ears formed on the bracket are positioned to retain the bracket by bearing against the inside surface of the front wall portions on either side of the slot. The bracket consists of a T-section formed by an upper flange and a triangular gusset plate having a protruding tail portion extending to the rear of the bracket ears and which is guided by a track or groove provided in the rear of the box channel section.

The bracket is tilted to provide clearance for the ears and partial disengagement of the tail portion of the track or groove in order to provide ready sliding adjustment of the bracket in the box channel standard.

The frictional interengagement is established at the selected position by rotation of the bracket downwardly, moving the bracket tail portion into lateral frictional engagement with the track or groove lateral surfaces, as well as frictional engagement with the rear surface of the tail portion with the rear of the track or groove, to provide a frictional securement of the bracket in its adjusted position.

Additional frictional engagement is provided by interengagement of the bracket ears and the interior surface of the box channel.

In the preferred embodiment, the lateral frictional forces are generated by an offset location of the track with respect to the box channel cavity which causes the bracket to be tilted, misaligning the tail portion and the track, when the bracket is inclined upwardly in the adjusting position. Upon downward tilting movement at the selected position, the tail portion is cammed into aligned and seated tight frictional engagement with the track side.

In other embodiments, the tail portion is pressfitted into a track slot such as to provide the lateral frictional forces augmenting the longitudinal frictional engagement surface therebetween.

The bracket is installed within the standard by the provision of one or more lateral slots formed through the front side of the standard, which accommodates the bracket ears such that the bracket may be inserted into the box channel interior without the necessity of being passed into the interior via an open end of the standard.

The rear located track is provided by any of several variations, i.e., it may be constituted by a rear located slot formed in the channel, or by a single offset rib. The slot may be formed integrally with the box section by a recessed slot extending into the rear wall of the channel, or by forwardly extending rib pairs, or by laterally extending ribs.

Alternatively, the track or groove may be formed in an insert installed in the interior of the body channel.

The lateral frictional forces may be afforded by a press fit within a plastic standard or plastic insert installed in the box channel cavity in the longitudinal track or groove. The tail portion of the bracket may be coated with plastic or otherwise provided with a means for readily establishing a press fit of the tail portion with the track groove.

DESCRIPTION OF THE DRAWINGS

FIGS. 9 through 11 are horizontal sectional views of various alternate embodiments of the box channel and standard bracket portions installed therein.

FIG. 12 depicts a horizontal sectional view of an alternate embodiment of the standard and associated bracket tail portions.

FIG. 13 is a perspective partial view of a box channel standard according to another variation of the concept according to the present invention depicting the tail portion of the bracket mating therewith.

FIGS. 14 and 15 are perspective view of brackets of alternate embodiments of the mounting arrangement according to the present invention.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
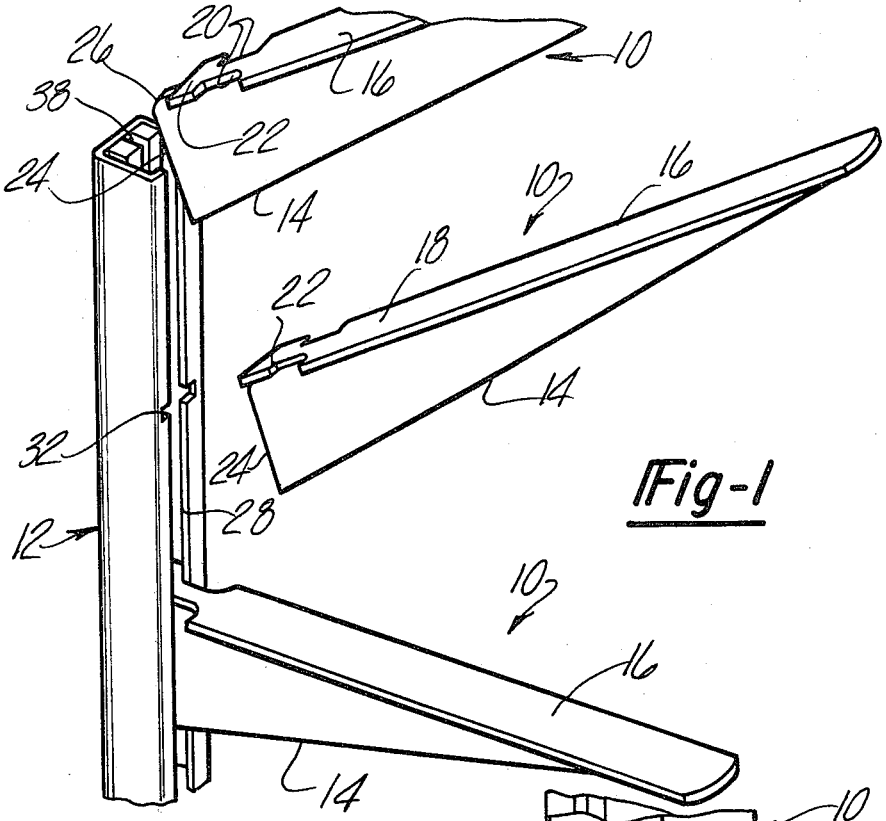
FIG. 1 is a perspective fragmentary view of a standard according to the present invention with a plurality of brackets in various positions assumed during installation.

Referring to FIG. 1, the mounting arrangement is intended to provide a securement of the bracket 10 to the elongate standard 12 which in turn is typically adapted to be secured to a vertical wall surface or other mounting surface as by screws or anchors. The bracket 10 in its mounted position extends generally horizontally, so as to provide a mounting structure for horizontally extending planar members such as for a shelving system.

The bracket 10 is generally T-shaped in section, with a triangular gusset plate or web 14, and a generally horizontally extending top flange 16 to which is secured the shelving as by screws passing through openings 18 in the top flange 16. The top flange 16 is centered on the gusset plate 14 to form the T-section.

The top flange 16 is relieved at 20 on either side of the gusset plate 14 intermediate its length thereof such as to define a pair of protuberances or bracket ears 22 at the rear of the bracket 10.

The gusset plate 14 extends a slight distance behind the bracket ears 22 such as to provide tail portion 24 consisting of the protruding rear edge of the gusset plate 14. The rounded corner 26 located below the bracket ears 22 cooperates with the bracket ears 22 to establish the frictional locking force, as will be described, and facilitates the installation of the bracket 10 to the standard 12, as will be appreciated upon a reading of the following details.

The box channel standard 12 is formed of a box section aluminum extrusion, with a frontally located longitudinally extending central slot 28, which is dimensioned to be somewhat larger than the thickness of the gusset plate 14 and which extends out through the slot 28 with the bracket 10 in the installed position with the bracket ears 22 disposed within the interior cavity 30 of the standard 12. The interior cavity 30 is generally square or rectangular in shape and is sized to correspond to the rectangular area defined by the bracket ears 22.

The bracket 10 is installed on the standard 12 by passing the ear portions into frontally located lateral slots 32 in the preferred embodiment, although the box channel may also be introduced through the free or open end of the standard 12 in a more conventional fashion.

Figure 6:
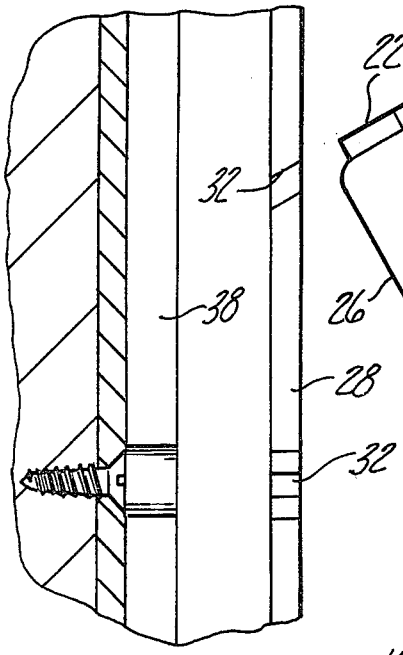
FIG. 6 is a front elevational view of a portion of the installed bracket and standard depicted in FIG. 5.

The lateral slots 32 may advantageously be inclined as seen in FIG. 6 upwardly such as to require the bracket 10 to be inclined upwardly in order to introduce the bracket ears 22 into the lateral slot 32 directly positioning the bracket 10 in the upwardly inclined position necessary in order to provide the free movement of the bracket in the interior of the mating end portions within the interior of cavity 30.

The standard 12 preferably is formed with the lateral slots 32 at locations whereat circular openings may be required in order to provide access for the installation mounting screws through the base of the back section of the standard 12 into the mounting surface. Thus, the slight loss of availability of the position of the lateral slots 32 is rendered less of a penalty since the locations whereat the screws pass through the rear of the standard 12 are unavailable in any event for the location of the bracket 10. At the same time, the forming operation forms the lateral slots 32, the screw holes being easily formed during the same operation. The holes can also be made sufficiently large so that ears may pass through or may be elongated for this same purpose.

Figure 2:
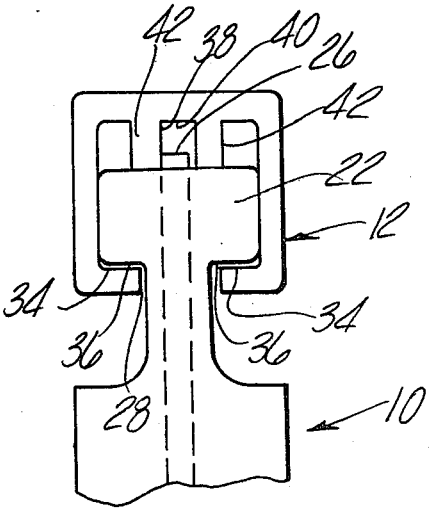
FIG. 2 is a partial sectional view of a bracket in place within the standard box channel.

When so inclined, bracket ears 22 may pass freely within interior cavity 30, such that the bracket 10 may be slid vertically up and down the standard 12. As indicated in FIG. 2, when the bracket 10 is so inclined, a clearance space is present between surfaces 34 of the bracket ears 22 and the interior surfaces 36 constituted by portions of the interior cavity 30 adjacent the central slot 28.

In this position, the rounded corner 26 extends into a rear track or slot 38 with the lower edge of the tail portion 24 extending forwardly out of the slot 38.

The slot 38 constitutes track means consisting of frontally directed surfaces which extend longitudinally down the length of the standard 12 along the rear wall. The slot 38 is positioned offset with respect to the sidewalls of the interior cavity 30 and with the slot 38.

Thus, the frontally extending surface of the track means is offset from the corresponding lateral surface of the tail portion 24 when the bracket 10 is located laterally by engagement of the bracket ears 22 and the sides of the interior cavity 30.

Figure 3:
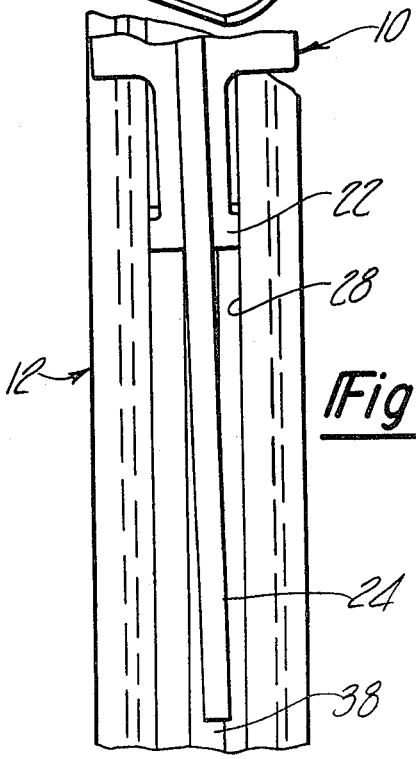
FIG. 3 is a horizontal sectional view of the standard.
Figure 4:
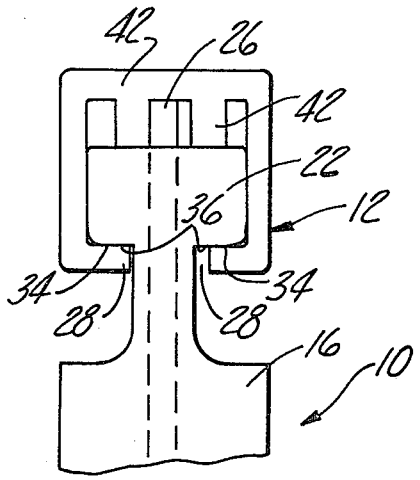
FIG. 4 is a fragmentary front elevational view of the tilted bracket and standard depicted in FIG. 2.
Figure 5:
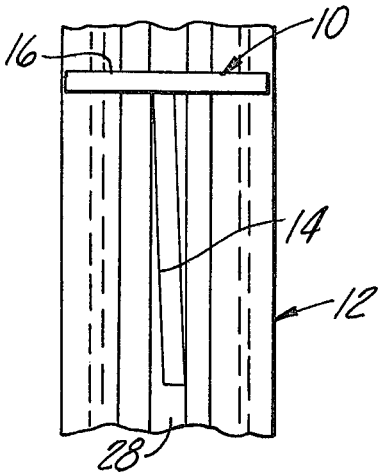
FIG. 5 is a horizontal sectional view through the box channel standard and a portion of the bracket with the bracket in the installed position.

The rounded corner 26 is positioned below the position of the bracket ears 22 measured along the depth of the bracket 10. Thus, after the bracket 10 is positioned within the interior cavity 30 in its inclined position, the rounded corner 26 tends to enter the slot 38. This offset and the difference in height along the depth of the bracket 10 of the bracket ears 22 and the rounded corner 26 tilts the tail portion 24 with respect to the slot 38 (FIGS. 2 and 3). As the bracket 10 is pulled down in the horizontal position, the tail portion 24 is cammed into alignment with the slot 38 by a forced deflection of the tail portion 24 (FIGS. 4 and 5). The reaction force to the lateral deflection of the tail portion is absorbed by the frontally directed surface of the slot 38, which thus generates lateral frictional forces acting between the bracket 10 and the slot 38 tending to resist any movement of the bracket 10 with respect to the standard 12.

The slot 38 is somewhat larger than the width of the gusset plate 14 to enable the accommodation of the offset distance and tilt of the bracket 10.

Accordingly, in use the bracket 10 is placed within the interior cavity 30 and, in an upward tilted position, is slid through the interior cavity 30 along the standard 12 until the appropriate location in the standard 12 is reached.

At this point, the bracket 10 is forced downwardly, with the frontal surfaces 34 providing a fulcrum after contacting the interior surface 36 of the interior cavity 30. This swings the lowermost region of the tail portion 24 towards the slot 38 located at the rearmost location of the interior cavity 30, causing camming of the tail portion 24 into the groove, notwithstanding the offset creating a jamming or wedging condition, which produces the lateral forces acting between the tail portion 26 and a sidewall of the slot 38 securing the bracket 10 in place.

At the same time, the rear surface of the tail portion 24 moves into abutment against the rear surface 40 of the slot 38 which generates frictional forces due to the moment exerted on the bracket by the fulcrum constituted by the front surface 34 and the weight which is borne by the bracket 10.

This frictional force combines with the lateral frictional force generated on the bracket ears 22 to provide a very secure retention of the bracket 10 in the selected position. This condition is shown in FIGS. 4 and 5 in which the bracket ears 22 completely occupy the interior cavity 30 and the tail portion 24 is moved into the slot 38.

The slot 38 and tail portion 24 constitute means for generating substantial frictional forces on side surfaces of the bracket 10 and interior cavity 30, while not requiring a critical fit of the tail portion 24 and the slot 38 otherwise necessitated by achieving such forces by a press fit. This augments the frictional forces acting between the bracket 10 and the standard 12 which has been relied on in the past to position the bracket 10 frictionally, as well as the engagement of the bracket ears 22 with the interior cavity 30 of the standard 12.

It will be appreciated that the slot 38 may be provided to be formed integrally with the standard 12 as in the extruded shape depicted in FIGS. 1 through 5.

Figure 7:
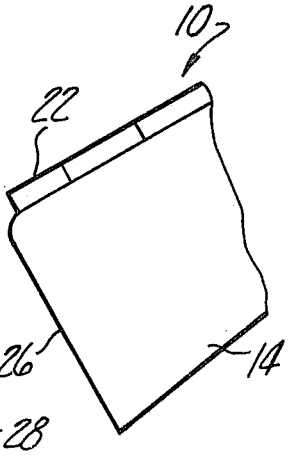
FIG. 7 is a partial sectional view of the standard box channel and the associated portion of the bracket, depicting the access slot formed therein according to one embodiment of the invention.
Figure 7:
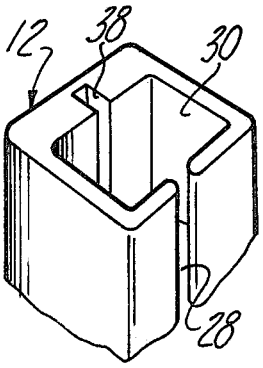

Referring to FIG. 7, the slot 38 may also be provided by a recess, provided by a pair of webs 42 extending forwardly out from the rear wall of the slot 38 or may be provided by a recess in the relatively heavy rear wall of the standard 12.

Figure 8:
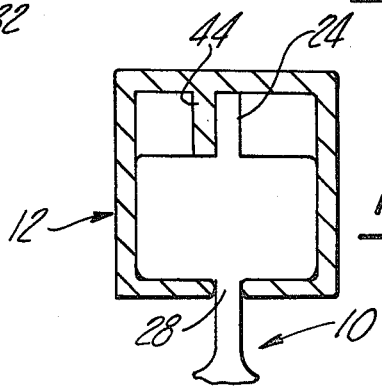
FIG. 8 depicts a perspective view of a portion of the box channel standard according to one alternate embodiment of the invention.

With the above description, it can be seen that the track means can be provided by many different geometries such as that depicted in FIG. 8 where a single rib 44 may be provided on the proper side of the offset. This is so since only one surface is engaged by the tail portion 24 upon rotation downwardly of the bracket 10.

FIGS. 9 through 11 depict various other arrangements of ribs 46, i.e., in FIG. 9, a crossing pattern; in FIG. 10, ribs 48 extending inwardly from the side surface of interior cavity 30; and, in FIG. 11, a crossing of ribs 50 in reverse orientation to that depicted in FIG. 9.

FIG. 12 depicts an arrangement whereby an insert 52 is provided within the standard 12, which insert is formed with a groove 54.

Instead of the offset slot described above, lateral frictional forces may be provided by means consisting of a press fit between the tail portion 24 of the bracket which can be provided by a plastic box channel standard 12 depicted in FIG. 13, with a simple press fit of a tail portion 24 and a groove 56. The plastic material of which the standard 12 is formed will allow a degree of resiliency such that a relatively large dimensional difference between the tail portion 24 and the width of the groove 56 is possible.

As shown in FIG. 14, an aluminum standard may be employed with a press fit with a pliable bond material 58 applied to the tail portion 24 of the bracket in order to provide for the reliable press fit established with the lateral surface frictional engagement.

It will also be appreciated that the bracket 10 may be constructed of plastic. In this case, the ears 60 (FIG. 15) are of increased thickness and have chamfer surfaces 62 in order to provide clearance for the tilting movement of the bracket 10.

It should be understood that a frictional lock may also be established between frontal surfaces 34 and interior surface 36 of interior cavity 30, and also between the rear edge of bracket ears 22 and the forward surface of webs 42, by appropriate dimensioning of these parts. This would be alternative to the engagement of the rear surface 40 with the tail portion 24 of the bracket 10.

It can be seen that the objects of the invention have been achieved by this arrangement in that only a simple two-piece bracket-standard mounting assembly is required and infinite adjustment of the bracket and standard is enabled without involving extra parts. The frictional engagement is easily established by merely rotating the standard of the bracket into the full horizontal position. The several frictional forces which are established insure a secure retention of the bracket in its adjusted position. This is achieved without the necessity for precision interfitting of parts nor complex part shapes. The provision of the horizontally or laterally extending slots formed in the front face of the box channel enables easy placement of the bracket for installing the same in the standard without requiring the open ends or entailing the inconvenience of removing the bracket-standard from the mounting surface.

The embodiments of the invention in which an exclusive property or privilege is claimed are defined as follows:

1. A bracket-standard mounting arrangement comprising:

a box channel standard consisting of an elongated member formed in generally box section shape, said standard formed with a slot extending longitudinally along one side thereof to provide an opening into the interior cavity defined by said box section shape;

a bracket including:

a gusset plate dimensioned to be positioned extending into said slot;

a pair of laterally extending ears secured to said gusset plate dimensioned to be received within said box channel standard interior cavity and retain said bracket therein by engagement with said interior cavity wall portions adjacent said slot;

said gusset plate formed with a tail portion configured to have a rear edge surface moved into engagement with a corresponding rear surface in said box channel interior cavity upon positioning said bracket in an installed position extending away from said box channel standard;

frictional engagement means generating substantial frictional forces acting directly between a lateral surface of said tail portion and said box channel standard upon said movement of said bracket into said installed position, whereby said bracket is securely mounted to said box channel standard by frictional engagement forces acting directly between rear and lateral surfaces of said bracket with said interior cavity, said frictional engagement means comprising track means extending longitudinally within said interior cavity and having at least one surface directed forwardly from the rear of said interior cavity of said bracket standard, and extending longitudinally along said box channel standard and wherein said frictional engagement means urges said forwardly directed surface and a lateral surface of said tail portion of said bracket gusset plate into engagement, whereby said frictional forces are generated therebetween upon movement of said bracket into said installed position, said frictional engagement means including locating means including said laterally extending ears acting on said bracket gusset plate tail portion to position said tail portion lateral surface within said interior cavity laterally offset from said track means at least one surface, said direction of offset and locating means tending to produce a tilt of said tail portion and a jam condition between said tail portion as said tail portion is moved into engagement with said fowardly extending surface, whereby said jam condition generates said lateral friction forces.

2. The bracket-standard mounting arrangement according to claim 1 wherein said locating means comprises lateral surfaces formed on said bracket ears engaging the sides of said interior cavity of said box channel standard, locating one lateral surface of said tail portion offset with respect to said forwardly directed surface of said track means.

3. The bracket-standard mounting arrangement according to claim 2 wherein said bracket ears extend from the top of said gusset plate forwardly of said tail portion rear edge, whereby said locating of said bracket in said interior cavity by said bracket ears and movement of said bracket into initial engagement with said forwardly extending surface of said track means produces said tilting of said gusset plate out of alignment with said forwardly extending surface of said track means, whereby downward tilting movement of said bracket cams said tail portion into alignment with said forwardly directed surface of said track groove means to generate said lateral friction forces.

4. The bracket-standard mounting arrangement according to claim 3 wherein said tail portion is formed with a rounded shoulder extending from said rear edge to said rear edge of said bracket ears, whereby clearance is provided for tilting movement of said bracket in the installed position.

5. The bracket-standard mounting arrangement according to claim 4 wherein said track means comprises a slot longitudinally extending along said rear surface of said interior cavity of said box channel standard.

6. The bracket-standard mounting arrangement according to claim 5 wherein said box channel section is formed with said slots by integrally formed ribs extending forwardly and along the length of said box channel standard.

7. The bracket-standard mounting arrangement according to claim 1 wherein said box channel standard is formed with a series of transverse slots extending into the front side of said box channel to form said longitudinal slot, said transverse slots configured to accommodate said bracket ears, whereby said bracket may be installed into said box channel standard by passing said ears into said transverse slot.

8. The bracket-standard mounting arrangement according to claim 7 wherein at least some of said series of transverse slots are formed with a central relief area aligned with a screw mounting hole located in the rear of said bracket-standard box channel, whereby said transverse slots are aligned with screw mounting holes formed in said box channel standard.

9. The bracket-standard mounting arrangement according to claim 1 wherein said frictional engagement means comprises a slot extending longitudinally along said box channel standard along the back side thereof, and wherein said gusset plate tail portion is press fitted into said insert upon positioning of said bracket-standard into said installed position.

10. The bracket-standard mounting arrangement according to claim 9 wherein said tail portion is formed with a pliable coating and press fitted with said longitudinally extending slot.

11. The bracket-standard mounting arrangement according to claim 9 wherein said box channel standard is formed of plastic and said bracket is comprised of metal.

12. The bracket-standard mounting arrangement according to claim 1 wherein said box channel standard is formed of aluminum extrusion and wherein said bracket is formed of metal.

* * * * *